US009605691B2

(12) United States Patent
Park

(10) Patent No.: US 9,605,691 B2
(45) Date of Patent: Mar. 28, 2017

(54) OIL PRESSURE SYSTEM FOR WHEEL LOADER

(75) Inventor: Moo Young Park, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 452 days.

(21) Appl. No.: 13/997,526

(22) PCT Filed: Dec. 26, 2011

(86) PCT No.: PCT/KR2011/010095

§ 371 (c)(1),
(2), (4) Date: Jun. 24, 2013

(87) PCT Pub. No.: WO2012/087081

PCT Pub. Date: Jun. 28, 2012

(65) Prior Publication Data

US 2013/0283775 A1 Oct. 31, 2013

(30) Foreign Application Priority Data

Dec. 24, 2010 (KR) ..... 10-2010-0134608

(51) Int. Cl.

| | |
|---|---|
| ***F15B 15/18*** | (2006.01) |
| ***E02F 9/22*** | (2006.01) |
| ***F15B 1/16*** | (2006.01) |

(52) U.S. Cl.

CPC ..... *F15B 15/18* (2013.01); *E02F 9/2207* (2013.01); *E02F 9/2235* (2013.01); *E02F 9/2242* (2013.01); *E02F 9/2292* (2013.01); *E02F 9/2296* (2013.01); *F15B 1/165* (2013.01)

(58) Field of Classification Search

CPC ..... F15B 15/24; F15B 15/2838; F15B 2211/7653; F15B 2211/8606; F15B 11/048; E02F 9/2214; E02F 9/2292; E02F 9/2207; E02F 9/22; E02F 9/2239

USPC ..... 60/428, 446, 452, 484, 486

See application file for complete search history.

(56) References Cited

U.S. PATENT DOCUMENTS

| | | | | |
|---|---|---|---|---|
| 4,586,330 A * | 5/1986 | Watanabe | ..... | E02F 9/2221 60/421 |
| 7,318,292 B2 * | 1/2008 | Helbling | ..... | E02F 9/2214 37/348 |
| 7,637,039 B2 * | 12/2009 | Toda | ..... | E02F 9/2235 37/195 |

(Continued)

FOREIGN PATENT DOCUMENTS

| | | |
|---|---|---|
| JP | 09-217384 A | 8/1997 |
| JP | 11-181842 A | 7/1999 |

(Continued)

OTHER PUBLICATIONS

Search Report dated Jul. 9, 2012 and written in Korean with English translation attached for International Patent Application No. PCT/KR2011/010095 filed Dec. 26, 2011, 5 pages.

*Primary Examiner* — F. Daniel Lopez
*Assistant Examiner* — Richard Drake
(74) *Attorney, Agent, or Firm* — John D. Veldhuis-Kroeze; Westman, Champlin & Koehler, P.A.

(57) ABSTRACT

The present disclosure provides an oil pressure system for a wheel loader with an improved raising process of a boom, thereby, especially, decreasing impact generated when the boom approaches a maximum height during loading work.

3 Claims, 5 Drawing Sheets

(56) References Cited

U.S. PATENT DOCUMENTS

| | | | | |
|---|---|---|---|---|
| 2003/0097836 | A1* | 5/2003 | Takahashi | E02F 9/2203 60/484 |
| 2004/0128868 | A1* | 7/2004 | Helbling | E02F 9/2214 37/348 |
| 2009/0151346 | A1* | 6/2009 | Kim | E02F 3/325 60/428 |

FOREIGN PATENT DOCUMENTS

| | | | |
|---|---|---|---|
| JP | 2001-248187 | A | 9/2001 |
| KR | 10-2009-0053523 | A | 5/2009 |

* cited by examiner

OIL PRESSURE SYSTEM FOR WHEEL LOADER

CROSS-REFERENCE TO RELATED APPLICATION

This Application is a Section 371 National Stage Application of International Application No. PCT/KR2011/010095, filed Dec. 26, 2011 and published, not in English, as WO2012/087081 on Jun. 28, 2012.

FIELD OF THE DISCLOSURE

The present disclosure relates to an oil pressure system for a wheel loader, and more particularly to a wheel loader which includes an oil pressure system having a confluent circuit and reduces the occurrence of impact during loading work.

BACKGROUND OF THE DISCLOSURE

A construction machine, such as a wheel loader, performs so-called loading work, and frequently performs an operation of raising a boom connected with a bucket to a predetermined height during the work. For example, in order to transfer a bucket on which a product is loaded to a specific position, such as an upper side of a cargo box of a truck during loading work, the boom connected with the bucket is raised to a position higher than that of the cargo box of the truck.

When the bucket is raised to a position lower than the specific position, there exists a risk of collision between the bucket and the cargo box to damage the bucket. Further, in a case where the boom is raised as described above, the boom is generally controlled at a maximum speed for work efficiency.

FIG. 1 is a schematic diagram of a wheel loader illustrated based on a front working device in the related art. According to FIG. 1, a wheel loader 100 includes a front working device consisting of a boom 20 having one end connected to a vehicle body frame 110 and driven by a boom cylinder 22, and a bucket 30 connected to a distal end of the boom 20 and driven by a bucket cylinder 32.

For example, force applied to the boom cylinder 22 may be expressed as Equation 1 below based on the illustration of FIG. 1.

$$P = W \times L1/L2 \cos\theta \qquad \text{Equation}$$

Here, P means force applied to the boom cylinder 22, W means external force applied to a center point A of the bucket 30, L1 is a length of A-C, L2 is a length of B-C, and θ means an angle of B-D-E.

As described above, the force P applied to the boom cylinder 22 is a function related to an angle between the boom cylinder 22 (for example, B-D of FIG. 1) and a vertical wall (for example, D-E of FIG. 1) of the vehicle body frame 10 connected with the boom cylinder 22, and according to Equation 1, the force applied to the boom cylinder 22 when the boom 20 is raised is further increased.

Accordingly, in a case where the boom cylinder 22 is expanded for loading work, the boom cylinder 22 is generally expanded at a maximum speed to increase work efficiency.

Further, the wheel loader in the related art generally includes a pair of left and right oil pressure pumps in order to drive the front working device, and the pair of left and right oil pressure pumps may supply hydraulic oil to the front working device, such as the boom cylinder, through a so-called confluent circuit.

Further, a predetermined cutoff pressure is set in each oil pressure pump. As a result, the cutoff pressure limits, for example, a pressure range of the boom cylinder, that is, a maximum rising pressure range of the boom, and determines maximum force generable by each oil pressure pump.

For example, as illustrated in FIG. 2, during the loading work of the wheel loader, when a joystick for operating the boom is maximally operated, a raising speed of the boom may be maintained at a maximum speed until the boom approaches a maximum height. As represented in Equation 1, since the force (pressure, P) applied to the boom cylinder is in proportion to a raising height of the boom, a predetermined pressure value corresponding to the maximum height of the boom is set as each cutoff pressure in each oil pressure pump. Accordingly, the boom 20 may be raised to the maximum height of the boom at the maximum speed.

However, as illustrated in FIG. 2, the pair of left and right oil pressure pumps simultaneously approach the cutoff pressure in a state where the raising speed of the boom is largest, so that an increase movement of the boom is temporarily stopped, and the boom, which is raised at the maximum speed, is temporarily stopped, and thus impact may be generated and an impulse may be transferred to the bucket connected to the other end of the boom.

Since the loading work is generally to load a product on the bucket and load the product on a cargo box of a truck, and the like, when the impulse is transferred to the bucket, the product loaded on the bucket may be lost. Further, when the boom cylinder is abruptly halted during the expansion of the boom cylinder at the maximum speed, stress due to the impact may also be accumulated to a whole machine including the boom cylinder.

In order to solve the problem, technology of tracking a position (height) of the boom and controlling a rise of the boom by an electronic control method has been developed. However, for the technology, additional problems, such as complexity of a manufacturing process including a necessity to additionally include required electronic constituent elements, and an increase in cost, may be incurred, and further, a new problem, such as an occurrence of failure by the additionally included electronic constituent elements, may be incurred.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

In order to solve the aforementioned problem, the present disclosure provides an oil pressure system for a wheel loader with an improved raising process of a boom, thereby, especially, decreasing impact generated when the boom approaches a maximum height during loading work.

In order to achieve the above object, the present disclosure provides an oil pressure system for a wheel loader including oil pressure pumps having different cutoff pressures, the wheel loader including: a pair of oil pressure pumps configured to discharge hydraulic oil; a plurality of working devices including a bucket cylinder (such as bucket cylinder 121 depicted in FIGS. 3 and 6), boom cylinders driven by a pressure of the hydraulic oil; and a control valve means configured to control a flow of the hydraulic oil through a predetermined oil pressure line from the oil pressure pump to the working device, in which the control means further includes a confluent circuit for making the hydraulic oils discharged from the pair of oil pressure pumps be confluent, the hydraulic oils discharged from the pair of oil pressure pumps are supplied together to the boom cylinders through the confluent circuit when the boom is raised to a maximum height during loading work of the wheel loader, and the pair of oil pressure pumps are set to have cutoff pressures having different sizes, so that impact generated when the boom approaches the maximum height is decreased.

The present disclosure is characterized by first cutting off an oil pressure pump supplying the hydraulic oil to the working device between the pair of oil pressure pumps.

Further, the present disclosure is characterized in that the different cutoff pressures set in the pair of oil pressure pumps are a maximum cutoff pressure corresponding to a pressure when the boom approaches a maximum height, and a predetermined cutoff pressure corresponding to a pressure when the boom approaches a predetermined height close to the maximum height.

Further, the present disclosure is characterized in that the predetermined height close to the maximum height is a height corresponding to approximately 90% of the maximum height.

According to the present disclosure, it is possible to provide the wheel loader with the improved boom raising process without including an additional electronic constituent element, and the like.

Further, according to the present disclosure, it is possible to decrease generated impact by decreasing a raising speed of the boom when the boom approaches a maximum height, for example, during loading work.

DESCRIPTION OF MAIN REFERENCE NUMERALS OF DRAWINGS

100: Wheel loader
110*a*, 110*b*: Oil pressure pump
111*a*, 111*b*: Pump regulator
120*a*, 120*b*: Cylinder
130: Control valve means
34132*a*, 132*b*: Main control valve
134: Confluent circuit
140: Oil pressure line

DETAILED DESCRIPTION

Hereinafter, an exemplary embodiment of the present disclosure will be described with reference to the accompanying drawings.

Figure 1:
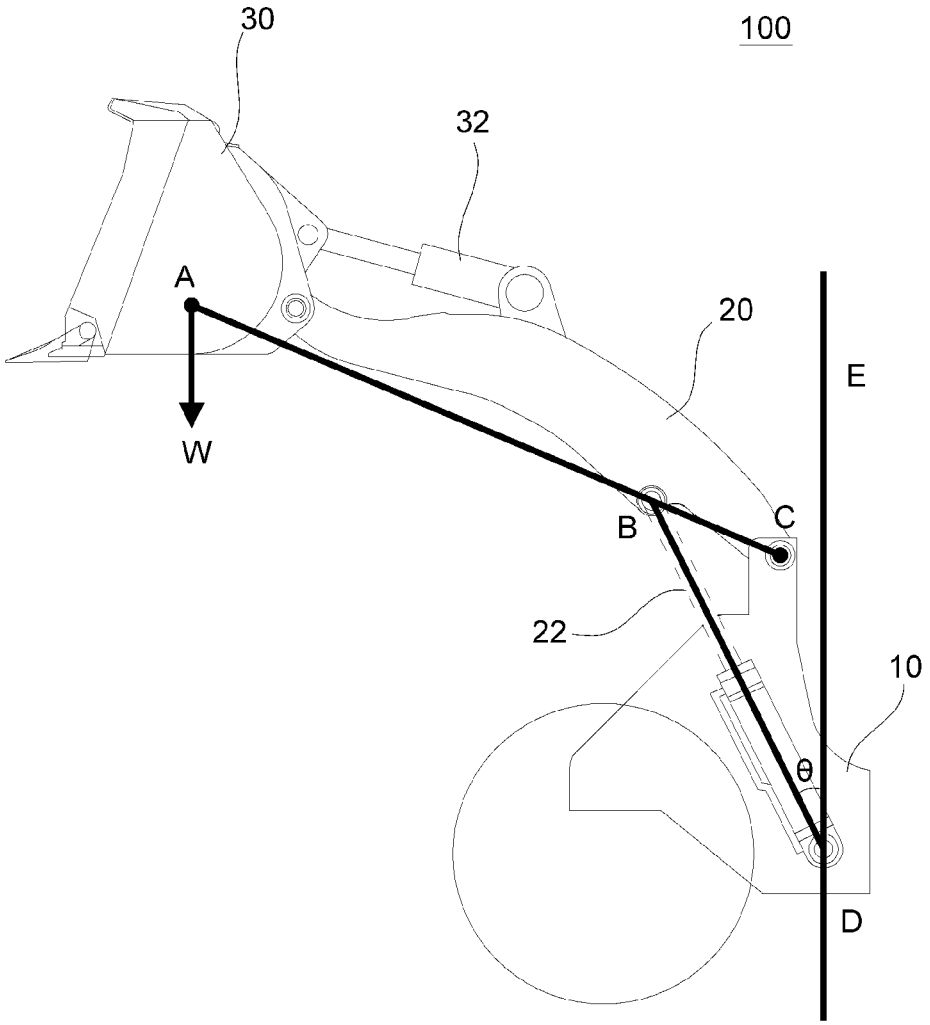
FIG. 1 is a schematic diagram of a wheel loader illustrated based on a front working device.
Figure 2:
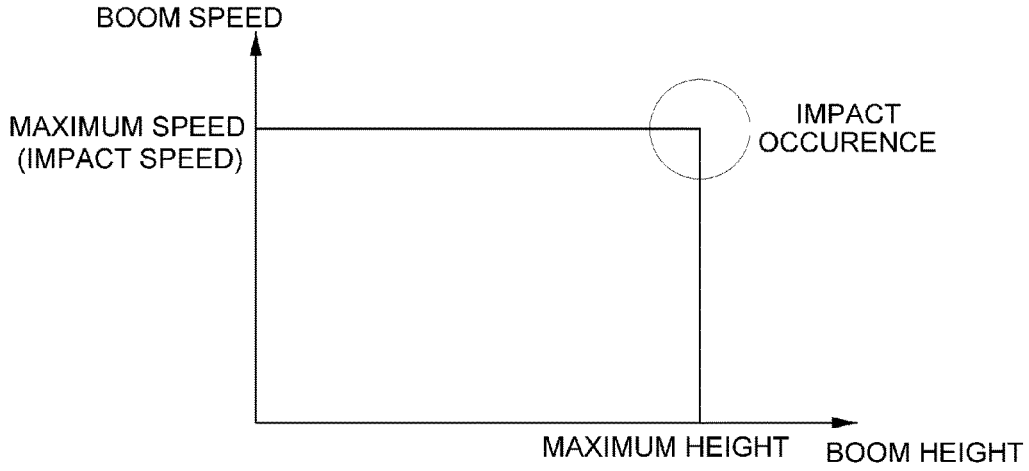
FIG. 2 is a diagram schematically illustrating a relationship between a raising speed of a boom and a height of the boom in the related art including oil pressure pumps having the same cutoff pressure.
Figure 3:
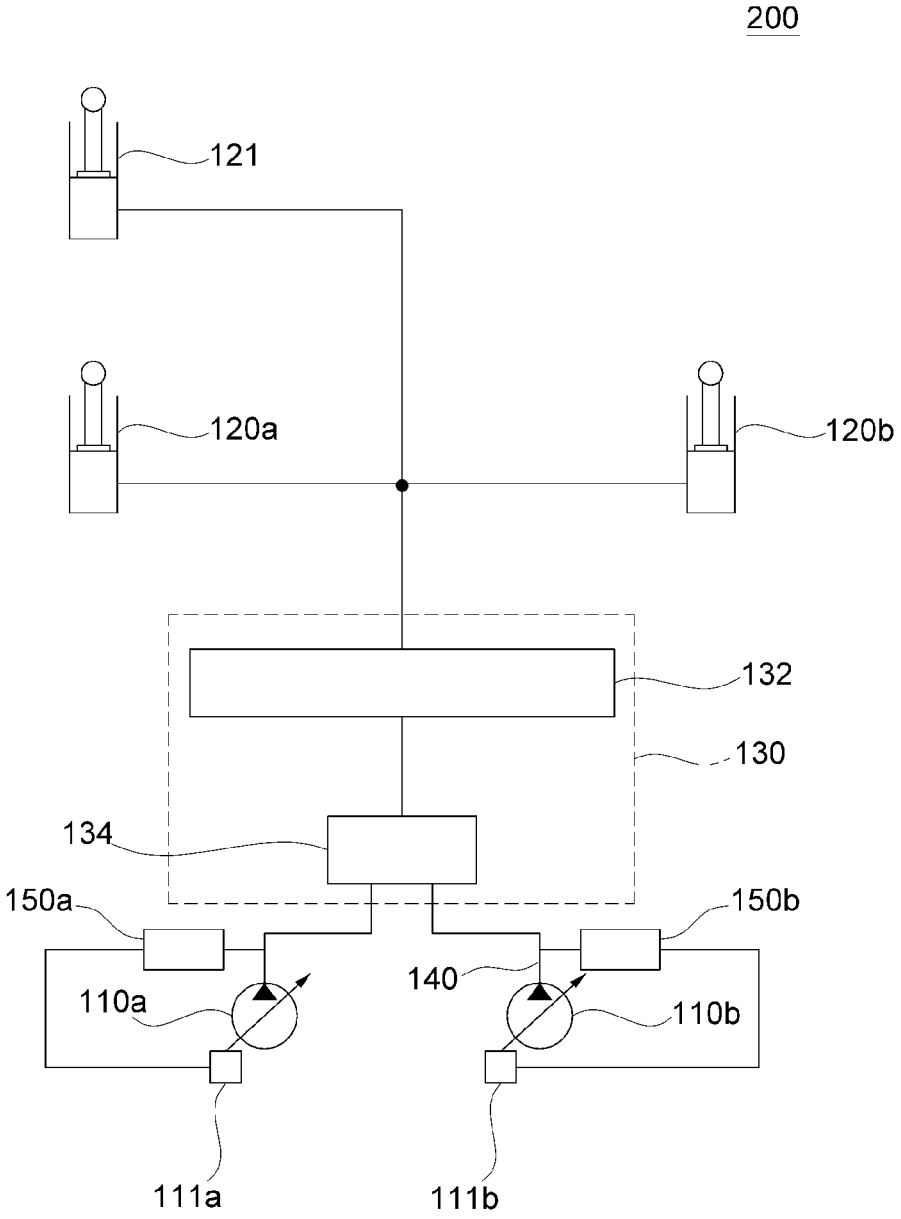
FIG. 3 is a block diagram schematically illustrating an oil pressure circuit of a wheel loader according to an exemplary embodiment of the present disclosure.

FIG. 3 is a block diagram schematically illustrating an oil pressure circuit of a wheel loader according to an exemplary embodiment of the present disclosure. FIG. 3 is an oil pressure circuit diagram schematically illustrated based on boom cylinders 120*a* and 120*b*, and an oil pressure line 140 supplying hydraulic oil to the boom cylinders 120*a* and 120*b*, and it may be noted that detailed elements, such as a pilot line, a variable flow adjustor, and a controller, are omitted.

Referring to FIG. 3, the wheel loader 100 applied to the present disclosure is characterized by connecting a pair of oil pressure pumps 110*a* and 110*b* to a control valve 132 of the boom cylinders 120*a* and 120*b* through a confluent circuit 134, and includes an oil pressure system in which hydraulic oil discharged from the pair of left and right oil pressure pumps 110*a* and 110*b* is also usable for raising the boom. In the present exemplary embodiment, a control valve means 130 for controlling a flow direction of the hydraulic oil is indicated with the control valve 132 and the confluent circuit 134, but it is obvious that the present disclosure is not limited thereto.

Figure 5:
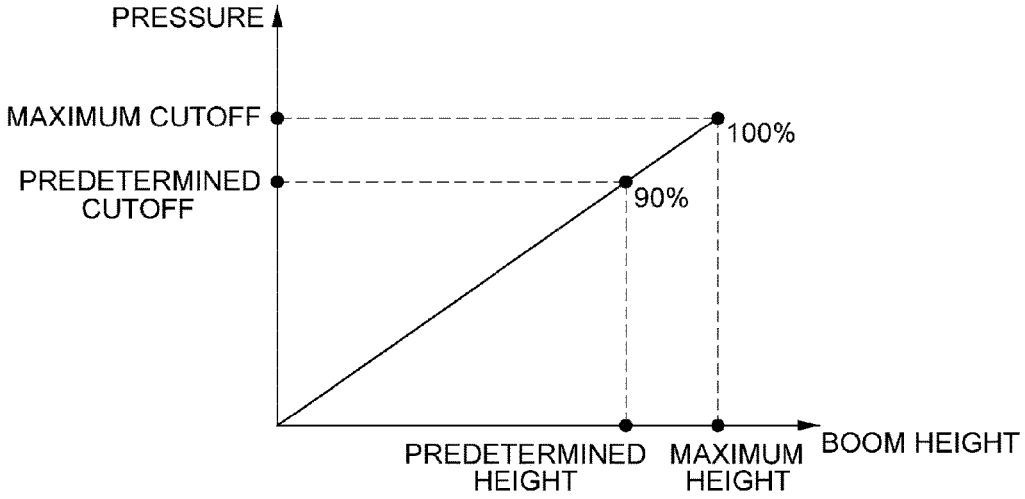
FIG. 5 is a diagram schematically illustrating a relationship between boom height and pressure.
Figure 6:
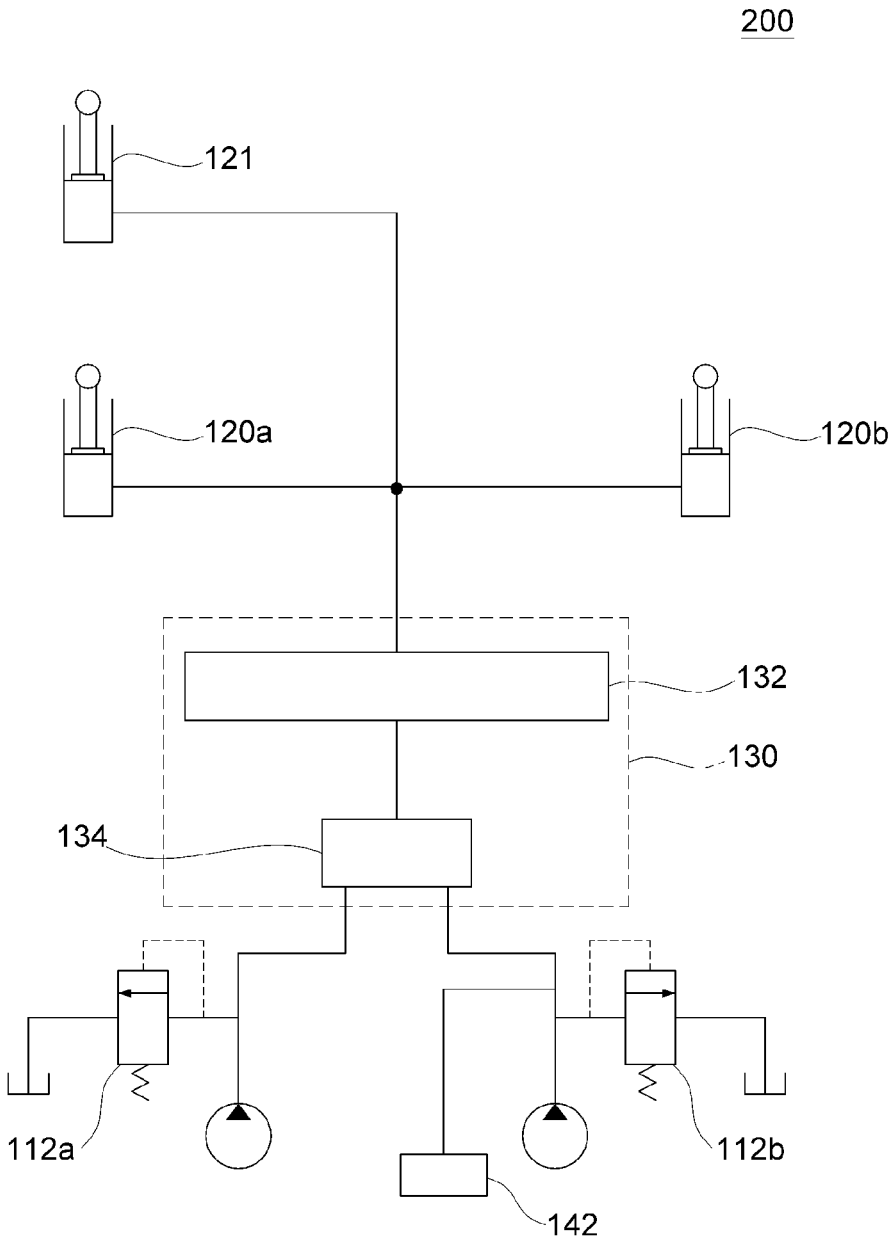
FIG. 6 is a block diagram schematically illustrating an oil pressure circuit of a wheel loader according to another exemplary embodiment of the present disclosure.

In addition, the pair of left and right oil pressure pumps 110*a* and 110*b* is characterized by having different cutoff pressures. For example, a pressure corresponding to a maximum height of the boom is set as a maximum cutoff pressure value in one oil pressure pump (for example, the oil pressure pump 110*a*) similar to the related art, but a pressure corresponding to a predetermined height close to the maximum height of the boom may be set as a predetermined cutoff pressure value in the other oil pressure pump (for example, the oil pressure pump 110*b*). For example, as shown in FIG. 5, the predetermined height close to the maximum height of the boom may be a height corresponding to approximately 90% of the maximum height of the boom when it is assumed that the maximum height of the boom is 100%. As described above, the pressure demanded by the boom may be changed according to a product loaded on the bucket. In the present exemplary embodiment, a case where the boom is raised to the maximum height in a state where the products are completely loaded therein the bucket is described as an example, but a pressure demanded by the boom, that is, the cutoff pressure, may be adjusted in response to a type and work of the vehicle. The setting of the cutoff pressure of the oil pressure pump may be implemented by the cutoff means of various pumps. For example, the cutoff means may be formed of a relief valve unit (such as relief valve unit 112*a* or 112*b* depicted in FIG. 6) adjusting relief pressure of a discharge line of the oil pressure pump, and may be formed of pump regulators 111*a* and 111*b* adjusting a discharge flow and a discharge pressure by adjusting a swash of each oil pressure pump. In the present exemplary embodiment, an example of adjusting a cutoff pressure by the cutoff means using the pump regulators 111*a* and 111*b* will be described. That is, when a discharge pressure of the oil pressure pump is equal to or larger than a predetermined pressure (such as shown in FIG. 5), the swash of the oil pressure pump is controlled by the pump regulators 111*a* and 111*b* in a state where the oil pressure pump does not substantially discharge a minimum flow of the hydraulic oil. To this end, a feedback of a discharge pressure of the oil pressure pump is necessary, which may be achieved by the publicly known technology of installing a separate pressure sensor (such as pressure sensor 150*a* or 150*b* depicted in FIG. 3), or branching a pressure signal line in the discharge line of the oil pressure pump and connecting the branched pressure signal lines to the pump regulators 111*a* and 111*b*, so that a detailed description thereof will be omitted herein.

In the meantime, the present disclosure further requires a sensor (not illustrated) capable of measuring a height of the boom, and the sensor may be configured in a form of an angle sensor installed in the boom cylinder to measure a stroke of the boom cylinder or measure a rotation angle of the boom.

As described above, the wheel loader according to the present disclosure is characterized by setting the different cutoff pressure values for the pair of left and right oil pressure pumps supplying the hydraulic oil through the confluent circuit. The different cutoff pressure values are set for the pair of left and right oil pressure pumps, respectively, so that it is possible to decrease impact generated when raising of the boom at the maximum speed and stopping during the loading work. For example, the present disclosure is characterized by setting a pressure corresponding to the maximum height of the boom as the maximum cutoff pressure value for one oil pressure pump similar to the related art, and setting a pressure corresponding to a height of approximately 90% of the maximum height of the boom as the predetermined cutoff pressure value for the other oil pressure pump according to the characteristic of the present disclosure. In the above description, the prevention of the impact by setting the cutoff pressure has been described as an example. However, when the oil pressure pump 110*a* is cutoff regardless of the cutoff pressure according to the height of the boom, the similar effect may be induced even in a case where a weight of the products is small, as well as a case where the boom is raised at the maximum pressure. That is, the effect of the boom impact prevention of the present disclosure may also be achieved by restricting, that is, cutting off, the discharge of the hydraulic oil of one oil pressure pump between the pair of oil pressure pumps in response to the height of the boom.

Figure 4:
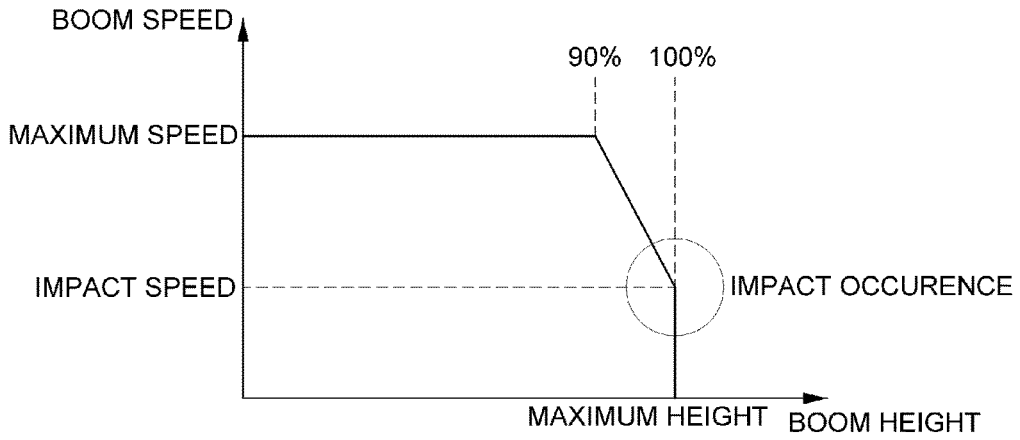
FIG. 4 is a diagram schematically illustrating a relationship between a raising speed of a boom and a height of the boom in the present disclosure including oil pressure pumps having different cutoff pressures.

In the oil pressure system in which the pair of oil pressure pumps 110*a* and 110*b* are confluent during typical driving of the boom, any one pump supplies the entire hydraulic oil to a front working device including the boom and the bucket, and the other pump divides the hydraulic oil and supplies the hydraulic oil to the aforementioned front working device and an additional device 142, for example, a steering device. In this case, the setting of a low cutoff pressure according to the exemplary embodiment of the present disclosure may be applied to the oil pressure pump 110*a* supplying the entire hydraulic oil to the front working device. The reason is that a case where the oil pressure pump 110 dividing and supplying the hydraulic oil to another additional device is set to have a low cutoff pressure may have a considerable effect in relieving the impact of the boom promoted in the present disclosure, but may incur other problems due to a shortage of a pressure or a flow of the hydraulic oil supplied to another additional device. FIG. 4 is a diagram schematically illustrating a relationship between a raising speed and a height of the boom when the pair of oil pressure pumps having the different cutoff pressure values according to the characteristic of the present disclosure is used. The characteristic of the present disclosure will be described below with reference to FIG. 4.

As illustrated in FIG. 4, the loading work in the wheel loader of the present disclosure may be performed with a maximum pressure by the hydraulic oil provided from the pair of oil pressure pumps until the boom approaches approximately 90% of the maximum height similar to the related art, and when the maximum flow of hydraulic oil is supplied in a state where the pressure of the hydraulic oil is at the maximum as described above, the boom may be raised at the maximum speed. The raising of the boom by using the maximum pressure of the hydraulic oil is performed in a case where the boom is raised to a maximum rising position in a state where a weight of products loaded on the bucket is close to an allowed weight of the wheel loader, or a case where a driver maximally operates the joystick in order to maximally increase the raising speed of the boom.

As described above, when the boom approaches approximately 90% of the maximum height, one oil pressure pump approaches the cutoff pressure, so that the supply of the hydraulic oil from the corresponding oil pressure pump is stopped, and thus the boom is raised only with the pressure of the hydraulic oil discharged from the other remaining oil pressure pump from the height corresponding to approximately 90% of the maximum height to the maximum height (100% height).

Accordingly, as illustrated in FIG. 4, the raising speed of the boom is gradually decreased, and the raising speed of the boom is maintained at a speed equal to or lower than approximately a half of that of the related art when the boom approaches the maximum height. Accordingly, it can be recognized that the boom approaches the maximum height and then stopped at a speed equal to or lower than a half of that of the related art, so that less impact is generated compared to the related art.

Accordingly, through a simple characteristic of setting the different cutoff pressures for the pair of left and right oil pressure pumps, it is possible to considerably decrease impact applied to the boom, the bucket, and the like at the maximum height of the boom during the loading work, and thus it is possible to considerably decrease a risk of losing a product due to impact, and also considerably decrease the amount of stress accumulated in each constituent element and the like.

Further, according to the characteristic of the present disclosure, since an additional constituent element is not required, it is possible to achieve the object of decreasing the impulse during the loading work to be achieved in the present disclosure without causing an increase in additional costs and inconvenience, such as an increase in complexity of a manufacturing process.

The present disclosure may be used in a wheel loader for decreasing impact generable during loading work.

Although the present disclosure has been described with reference to exemplary and preferred embodiments, workers skilled in the art will recognize that changes may be made in form and detail without departing from the spirit and scope of the disclosure.

The invention claimed is:

1. An oil pressure system for a wheel loader including oil pressure pumps having different cutoff pressure values, the system comprising:

a pair of oil pressure pumps configured to discharge hydraulic oil;

a plurality of working devices including a front working device that includes only boom cylinders and a bucket cylinder and is driven by a pressure of the hydraulic oil;

a confluent circuit configured to make the hydraulic oil discharged from the pair of oil pressure pumps be confluent; and a pair of pump regulators configured to:

adjust a swash of each of the pair of oil pressure pumps, respectively;

make the hydraulic oil discharged from the pair of oil pressure pumps be supplied to the boom cylinders through the confluent circuit when the pressure of the hydraulic oil discharged from the pair of oil pressure pumps is smaller than a predetermined cutoff pressure; and cut off one of the pair of oil pressure pumps so that only the hydraulic oil discharged from the other one of the pair of oil pressure pumps is supplied when the pressure of the hydraulic oil discharged from the pair of oil pressure pumps is equal to or larger than the predetermined cutoff pressure, so that impact generated when the boom approaches a maximum height is decreased, wherein the one of the pair of oil pressure pumps that supplies the hydraulic oil only to the front working device is first cut off.

2. The oil pressure system of claim 1, wherein the predetermined cutoff pressure set in the pair of oil pressure pumps corresponds to a pressure when the boom approaches a predetermined height close to the maximum height.

3. An oil pressure system for a wheel loader including oil pressure pumps having different cutoff pressure values, the system comprising:

a pair of oil pressure pumps configured to discharge hydraulic oil;

a plurality of working devices including a front working device that includes only boom cylinders and a bucket cylinder and is driven by a pressure of the hydraulic oil;

a confluent circuit configured to make the hydraulic oil discharged from the pair of oil pressure pumps be confluent; and a pair of relief valves configured to:

adjust relief pressure of discharge lines of each of the pair of oil pressure pumps, respectively;

make the hydraulic oil discharged from the pair of oil pressure pumps be supplied to the boom cylinders through the confluent circuit when the pressure of the hydraulic oil discharged from the pair of oil pressure pumps is smaller than a predetermined cutoff pressure; and cut off one of the pair of oil pressure pumps so that only the hydraulic oil discharged from the other one of the pair of oil pressure pumps is supplied when the pressure of the hydraulic oil discharged from the pair of oil pressure pumps is equal to or larger than the predetermined cutoff pressure, so that impact generated when the boom approaches a maximum height is decreased, wherein the one of the pair of oil pressure pumps that supplies the hydraulic oil only to the front working device is first cut off.

* * * * *